US009714532B2

(12) United States Patent
Peatey et al.

(10) Patent No.: US 9,714,532 B2
(45) Date of Patent: Jul. 25, 2017

(54) LATCH ASSEMBLY WITH PAWL SWITCH OVERRIDE DEVICE

(71) Applicants: David Peatey, Solihull (GB); Thomas Liepold, Gaimersheim (DE)

(72) Inventors: David Peatey, Solihull (GB); Thomas Liepold, Gaimersheim (DE)

(73) Assignee: INTEVA PRODUCTS, LLC, Troy, MI (US)

( * ) Notice: Subject to any disclaimer, the term of this patent is extended or adjusted under 35 U.S.C. 154(b) by 263 days.

(21) Appl. No.: 14/327,044

(22) Filed: Jul. 9, 2014

(65) Prior Publication Data

US 2015/0035292 A1 Feb. 5, 2015

Related U.S. Application Data

(60) Provisional application No. 61/845,184, filed on Jul. 11, 2013.

(51) Int. Cl.

| | |
|---|---|
| ***E05C 3/06*** | (2006.01) |
| ***E05B 85/00*** | (2014.01) |
| ***E05B 81/20*** | (2014.01) |
| ***E05B 81/66*** | (2014.01) |
| ***E05B 81/68*** | (2014.01) |
| *E05C 3/00* | (2006.01) |
| *E05B 81/00* | (2014.01) |

(52) U.S. Cl.

CPC ..... *E05B 85/00* (2013.01); *E05B 81/20* (2013.01); *E05B 81/66* (2013.01); *E05B 81/68* (2013.01); *E05B 81/00* (2013.01); *Y10T 292/1043* (2015.04)

(58) Field of Classification Search

CPC ..... E05B 81/00; E05B 81/20

USPC ..... 292/201, 216

See application file for complete search history.

(56) References Cited

U.S. PATENT DOCUMENTS 4,219,227 A * 8/1980 Grabner ..... E05B 85/24 292/201

4,848,031 A * 7/1989 Yamagishi ..... E05B 81/20 292/DIG. 72

(Continued)

FOREIGN PATENT DOCUMENTS

| | | |
|---|---|---|
| EP | 2071106 A1 | 6/2009 |
| GB | 2275078 A | 8/1994 |
| GB | 2321276 A | 7/1998 |

OTHER PUBLICATIONS

Great Britain Search Report of related GB Application No. 1412281.6; Dated Mar. 5, 2015, 5 pages.

*Primary Examiner* — Carlos Lugo

(74) *Attorney, Agent, or Firm* — Cantor Colburn LLP

(57) ABSTRACT

In one aspect, a latch assembly is provided. The latch assembly includes a claw movable between a latched position and an unlatched position, and a pawl movable between a first position and a second position. The pawl engages and holds the claw in the latched position when the pawl is in the first position, and the pawl disengages the claw for movement to the unlatched position when the pawl is in the second position. The latch assembly also includes a switch cam movable between a switch-off position and a switch-on position. The claw engages and holds the switch cam in the switch-on position when the claw is in the unlatched position, the claw releasing the switch cam for movement to the switch-off position when the claw rotates to the latched position.

10 Claims, 4 Drawing Sheets

(56) References Cited

U.S. PATENT DOCUMENTS

| | | | | | |
|---|---|---|---|---|---|
| 5,273,324 | A * | 12/1993 | Kobayashi | E05B 81/20 | 292/201 |
| 5,516,164 | A * | 5/1996 | Kobayashi | E05B 81/20 | 292/201 |
| 5,564,761 | A * | 10/1996 | Mizuki | E05B 81/20 | 292/201 |
| 5,613,716 | A * | 3/1997 | Cafferty | E05B 81/14 | 292/201 |
| 5,618,068 | A * | 4/1997 | Mitsui | E05B 81/20 | 292/201 |
| 5,785,364 | A | 7/1998 | Kleefeldt et al. | | |
| 5,938,252 | A * | 8/1999 | Uemura | E05B 81/14 | 292/201 |
| 5,951,069 | A * | 9/1999 | Kobayashi | E05B 81/06 | 292/201 |
| 6,048,003 | A * | 4/2000 | Shimura | E05B 81/20 | 292/201 |
| 6,279,361 | B1 * | 8/2001 | Baukholt | E05B 81/14 | 292/201 |
| 6,523,376 | B2 * | 2/2003 | Baukholt | E05B 81/14 | 292/201 |
| 6,659,515 | B2 * | 12/2003 | Raymond | E05B 81/20 | 292/201 |
| 6,848,727 | B1 * | 2/2005 | Cetnar | E05B 81/20 | 292/201 |
| 7,210,714 | B2 * | 5/2007 | Berghahn | E05B 81/20 | 292/201 |
| 8,033,584 | B2 * | 10/2011 | Akizuki | E05B 81/20 | 292/201 |
| 8,870,246 | B2 * | 10/2014 | Itami | E05B 81/20 | 292/201 |
| 2010/0194120 | A1 | 8/2010 | Kaiser et al. | | |

* cited by examiner

LATCH ASSEMBLY WITH PAWL SWITCH OVERRIDE DEVICE

CROSS REFERENCE TO RELATED APPLICATIONS

This application claims the benefit of U.S. Provisional Patent Application, Ser. No. 61/845,184 filed on Jul. 11, 2013, the contents of which are incorporated herein by reference thereto.

BACKGROUND

Exemplary embodiments of the present invention relate generally to latches and, more particularly, to latches for vehicles.

Some known vehicles typically include displaceable panels such as doors, windows, hood, trunk lid, hatch and the like which are affixed for hinged or sliding engagement with a vehicle body. Cooperating systems of latches and strikers are typically provided to ensure that such panels remain secured in their fully closed position when the panel is closed.

A latch typically includes a fork bolt or claw that is pivoted between an unlatched position and a primary latched position when the door is closed to latch the door in the closed position. The fork bolt is typically held in the primary latched position by a detent lever or pawl that pivots between an engaged position and a disengaged position. The detent lever holds the fork bolt in the primary latched position when in the engaged position and releases the fork bolt when in the disengaged position so that the door can be opened.

The fork bolt is pivoted to the primary latched position by a striker attached to, for example, an associated doorjamb when the door is closed. Once in the primary latched position, the detent lever engages the fork bolt to ensure the assembly remains latched.

In some known vehicles, doors may be automatically power closed by a motor when the door is in a certain position, for example, a first safety position. Typically, a switch associated with the detent lever may fail to indicate when the door is open. This may lead to the motor constantly trying to power close the door when the door is not in a position for a successful power close operation. Accordingly, it is desirable to provide an improved latch assembly.

SUMMARY OF THE INVENTION

In one non-limiting embodiment, a latch assembly is provided. The latch assembly includes a claw movable between a latched position and an unlatched position, and a pawl movable between a first position and a second position. The pawl engages and holds the claw in the latched position when the pawl is in the first position, and the pawl disengages the claw for movement to the unlatched position when the pawl is in the second position. The latch assembly also includes a switch cam movable between a switch-off position and a switch-on position. The claw engages and holds the switch cam in the switch-on position when the claw is in the unlatched position, and the claw releases the switch cam for movement to the switch-off position when the claw rotates to the latched position.

In another non-limiting embodiment, a vehicle is provided. The vehicle includes a controller, a door, and a door latch assembly. The door latch assembly includes a claw movable between a latched position and an unlatched position, and a pawl movable between a first position and a second position. The pawl engages and holds the claw in the latched position when the pawl is in the first position, the pawl disengaging the claw for movement to the unlatched position when the pawl is in the second position. The latch assembly further includes a switch cam movable between a switch-off position and a switch-on position. The claw engages and holds the switch cam in the switch-on position when the claw is in the unlatched position, and the claw releases the switch cam for movement to the switch-off position when the claw rotates to the latched position. The latch assembly further includes a switch communicatively coupled to the controller. The switch cam engages the switch in the switch-on position and the switch sends a signal to the controller indicating an open/closed condition of the door.

In yet another non-limiting embodiment, a method of overriding a pawl switch when a vehicle door is opened is provided. The method includes rotating a claw from a latched position to an unlatched position, the claw engaging a cam switch in the unlatched position, rotating the switch cam from a switch-off position to a switch-on position when the claw engages the switch cam, and transitioning the pawl switch from an "off" condition to an "on" condition when the switch cam rotates to the switch-on position.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Described herein is an exemplary latch assembly that includes a pawl override system. In some known systems, a motor of a power close mechanism may continue to operate when a door is in a position where the power close mechanism cannot perform its intended function (e.g., when the door is open and too far from the mechanism). Accordingly, the exemplary pawl override system facilitates preventing the motor of the power close mechanism from operating when not required.

Figure 2:
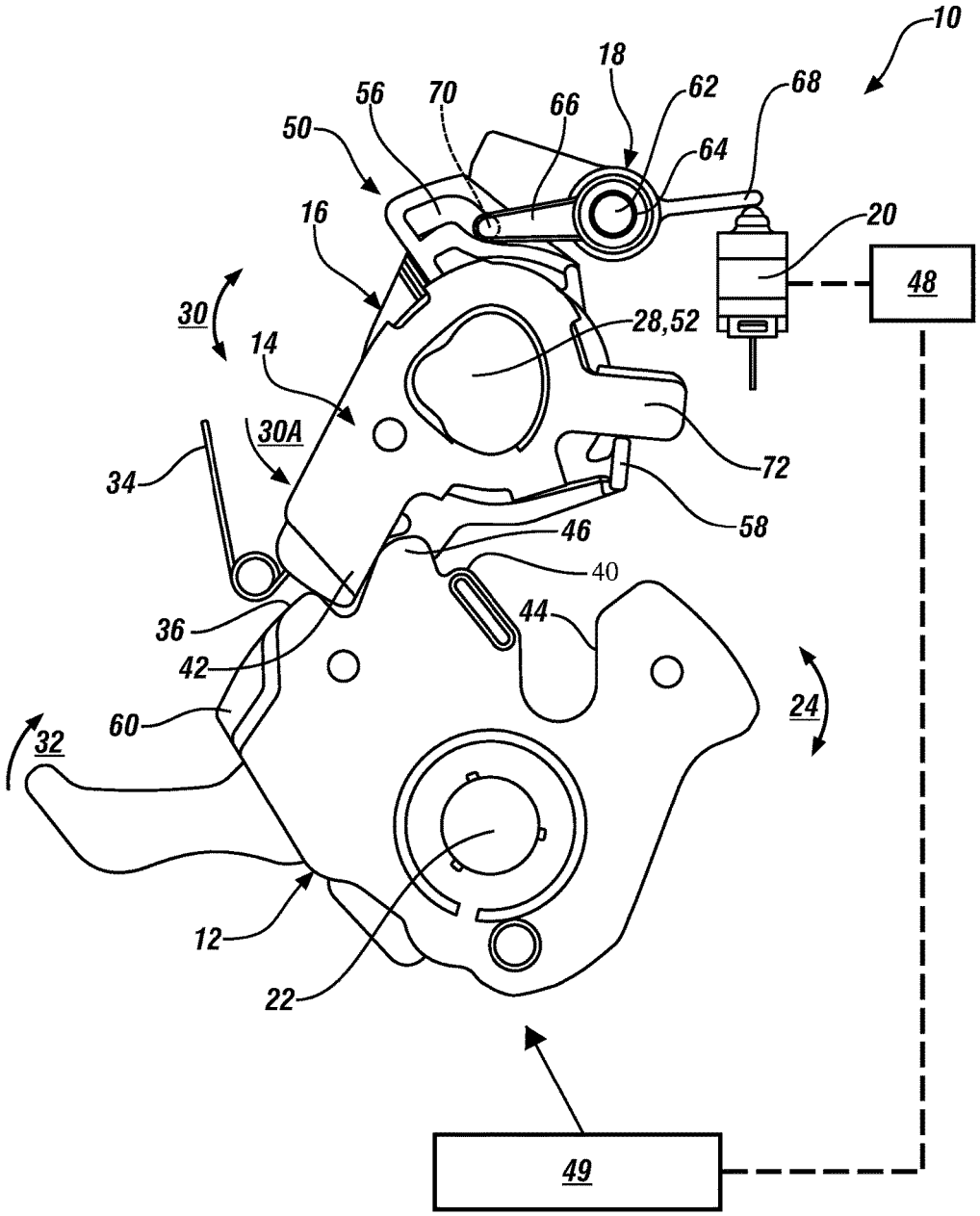
FIG. 2 is a side view of a door latch in a safety position according to an embodiment of the invention.
Figure 3:
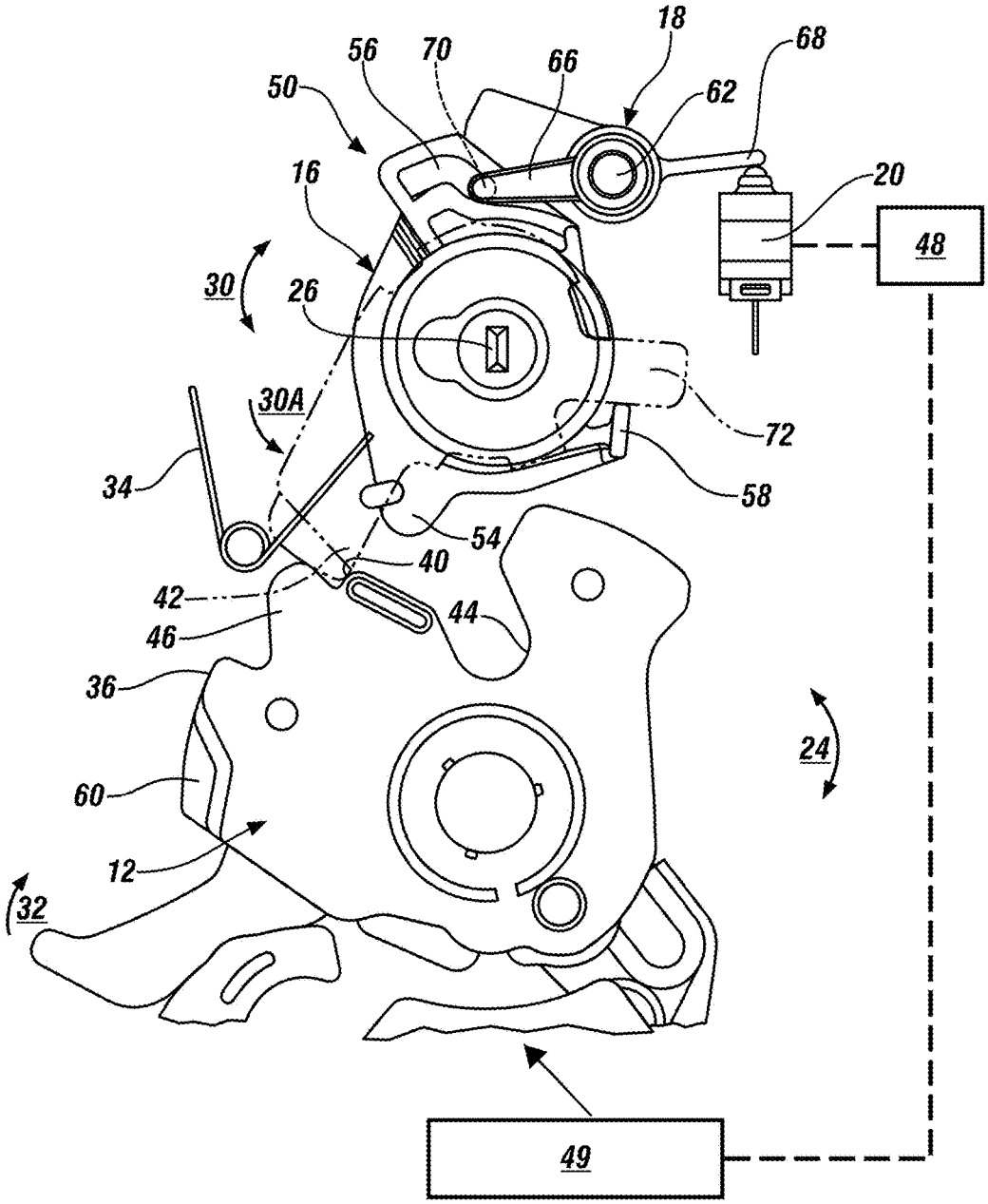
FIG. 3 is a side view of a door latch in a closed position according to an embodiment of the invention.
Figure 4:
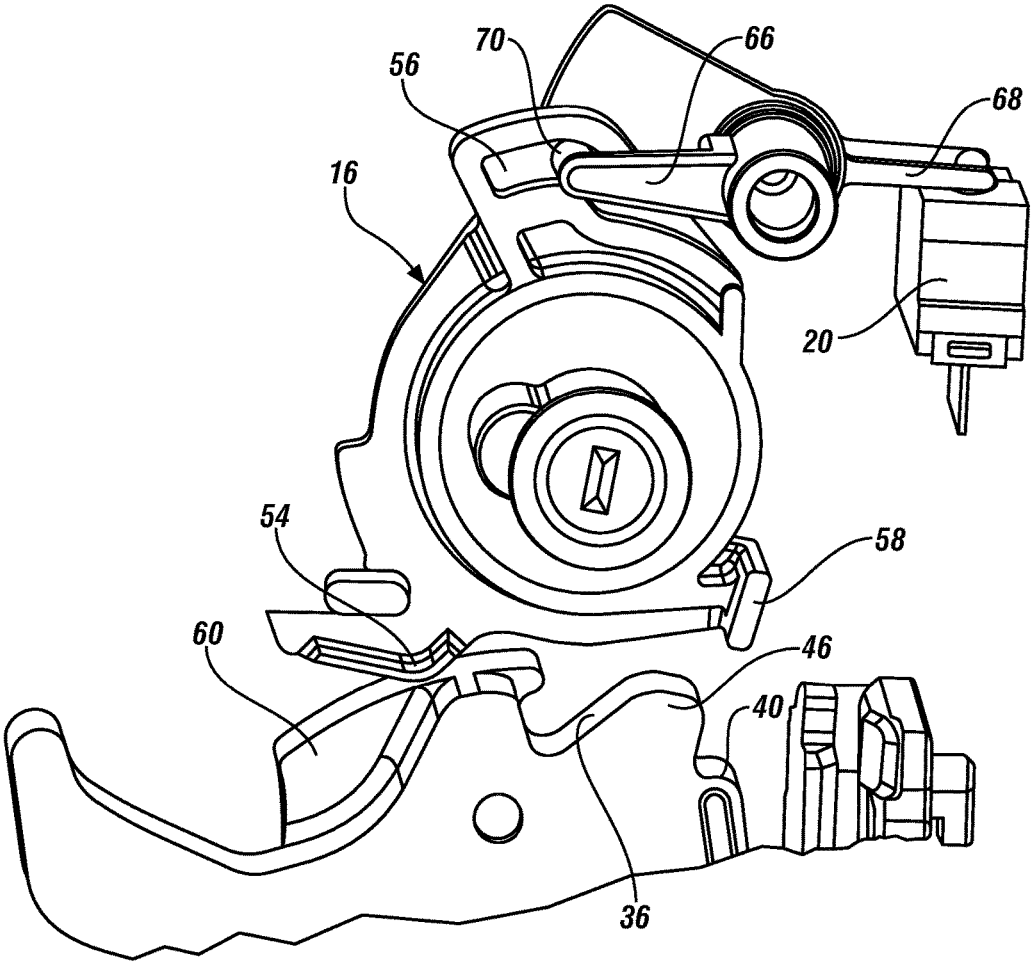
FIG. 4 is a perspective view of the door latch shown in FIG. 1 with a pawl removed.

Referring now to the FIGS., an exemplary latch assembly 10 is illustrated in an open position (FIGS. 1 and 4), an intermediate safety position (FIG. 2), and a closed position (FIG. 3). Latch assembly 10 may be integrated into a component of a vehicle, such as the vehicle door, trunk, frame surrounding the door opening or trunk opening or any other operable component for example. Latch assembly 10 generally includes a claw 12, a cooperating pawl 14, a switch cam 16, a switch drive 18, and a switch 20.

Claw 12 is pivotally or rotationally mounted about a pivot pin (not shown) that is received within an opening 22. Claw 12 is capable of rotational movement between an open or unlatched position shown in FIG. 1 and a closed or latched position shown in FIG. 3, wherein claw 12 rotates in the direction of arrows 24.

Latch assembly 10 is attached to a vehicle structure such that claw 12 is moved between the open position (FIG. 1) and the closed position (FIG. 3) when a door, window, lift gate, etc. is opened and closed and claw 12 engages a striker (not shown) that is attached to the door, window, lift gate, etc. In the exemplary embodiment, latch assembly 10 includes safety position (FIG. 2) that is an intermediate position between the open position and the closed position. Alternatively, latch assembly 10 is secured to the door, window, lift gate, etc. and the striker is secured to the vehicle body at an opening into which the door, window, lift gate, etc. is received. The cooperation of a claw and striker is well known and need not be described in detail.

Figure 1:
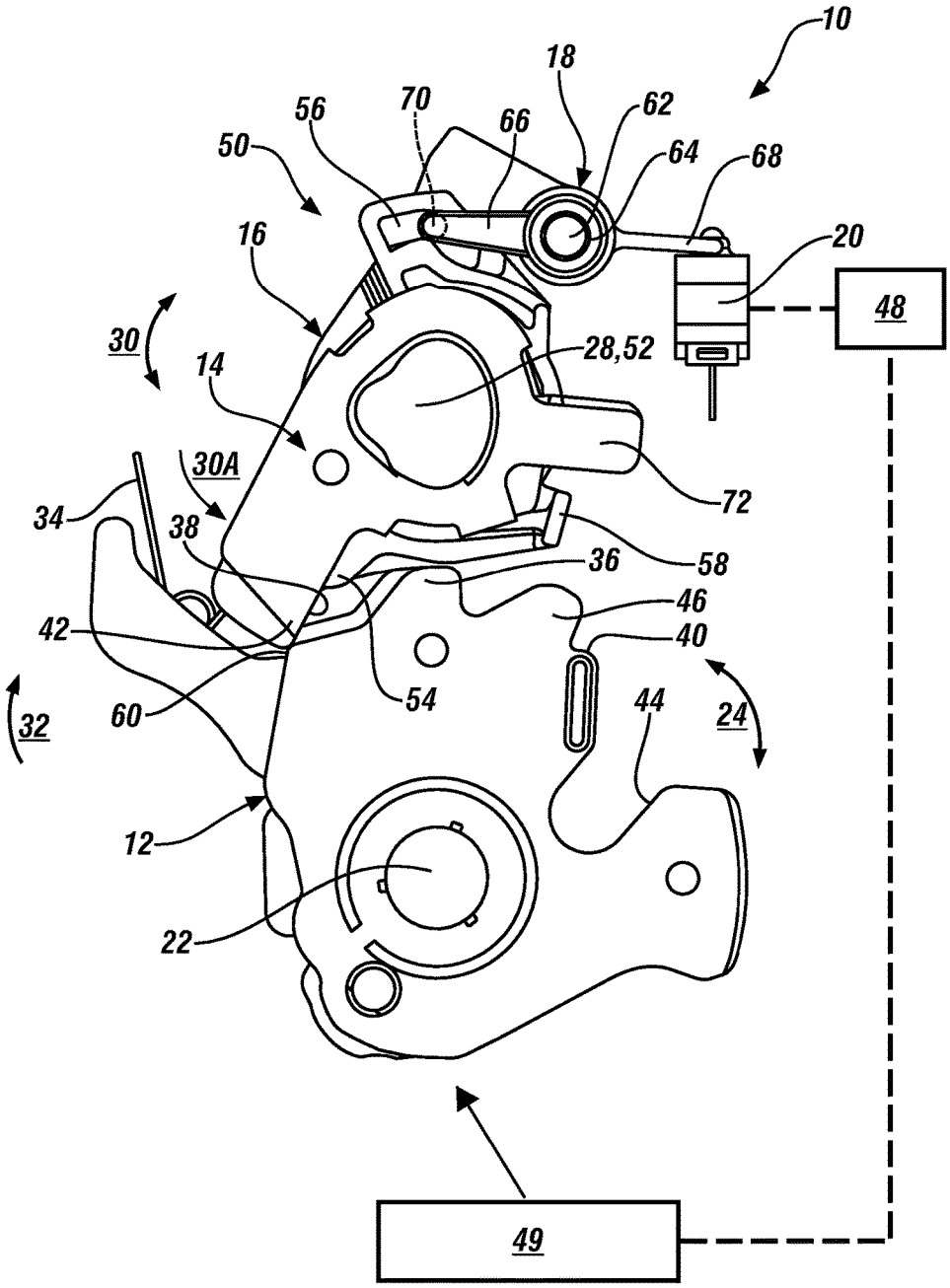
FIG. 1 is a side view of a door latch in an open position according to an embodiment of the invention.

Pawl 14 is pivotally mounted by a stud 26 received within a stud aperture 28 formed within pawl 14. Pawl 14 cooperates with claw 12 in a well-known manner to retain claw 12 in the safety position (FIG. 2) and the closed position (FIG. 3), or release claw 12 for return to the open position (FIG. 1). That is, pawl 14 pivots between a release or disengaged first position shown in FIG. 1 in the direction of arrows 30, a closed or engaged second position shown in FIG. 2, and a closed or engaged third position shown in FIG. 3. In the exemplary embodiment, claw 12 is spring biased clockwise to the open position shown in FIG. 1 or in the direction of arrow 32 by a biasing member (e.g., coil or torsion spring or other equivalent member) that has one end attached to claw 12 and the other end attached to the housing or other equivalent location. Similarly, a biasing member 34 biases pawl 14 in the direction of arrow 30A counterclockwise against a face of claw 12.

In the exemplary embodiment, claw 12 has a surface 36 that slides along a complimentary surface 38 of pawl 14 when claw 12 rotates from the open position (FIG. 1) to the closed position (FIG. 3). Once in the closed position (FIG. 3), a claw shoulder portion 40 engages a pawl shoulder portion 42 thus engaging claw 12 and securing it into the closed position when the striker is secured in a receiving opening 44 of claw 12. Once the latch assembly 10 is in the closed position, pawl 14 is spring biased in the direction of arrow 30A and shoulder 40 engages shoulder 42 such that claw 12 cannot rotate into the open position unless pawl 14 is moved back to the release or disengaged position (e.g., moving shoulder 42 away from shoulder 40) allowing claw 12 to rotate in the direction of arrow 32 into the open position.

Claw 12 also includes a second shoulder portion 46 that is engaged by pawl shoulder portion 42 when claw 12 has been engaged by the striker as the door is closed to the safety position (FIG. 2) at which point the door is still slightly ajar, with little or no compression of its weather seals (not shown), for example. Once in the safety position (FIG. 2), claw second shoulder portion 46 engages pawl shoulder portion 42 thus engaging claw 12 and securing it into the first safety position. Once latch assembly 10 is in the closed position, pawl 14 is spring biased in the direction of arrow 30A and shoulder 46 engages shoulder 42 such that claw 12 cannot rotate into the open position unless pawl 14 is moved back to the release or disengaged position (e.g., moving shoulder 42 away from shoulder 40) allowing claw 12 to rotate in the direction of arrow 32 into the open position. Further, in the exemplary embodiment, once latch assembly 10 is in the first safety position, a controller 48 in communication with a power closing mechanism 49 (shown schematically) actuates the power closing mechanism to transition assembly 10 to the closed position (FIG. 3), as is described herein in more detail.

In the exemplary embodiment, latch assembly 10 includes a pawl override system 50 that interrupts the normal operation of pawl switch 20 during a door open condition. Pawl override system 50 includes switch cam 16 and switch drive 18, which facilitate transitioning switch 20 between an "on" condition and an "off" condition for communication with controller 48.

Switch cam 16 is pivotally or rotationally mounted by stud 26 received within a stud aperture 52, and switch cam 16 may rotate with or independently from pawl 14 during rotation of switch cam 16, as described herein in more detail. In the exemplary embodiment, switch cam 16 includes a shoulder portion 54, a ramp channel 56 and a pawl contact portion 58. Switch cam shoulder portion 54 is engaged by a ramp 60 of claw 12 when claw 12 is in the open position (FIG. 1) such that switch cam 16 is held in a switch-on position. Contact portion 58 is engaged by pawl 14 when claw 12 is in the closed position (FIG. 3) such that switch cam 16 is also in the switch-on position. Switch cam 16 is not engaged by claw 12 when claw 12 is in the safety position (FIG. 2) such that switch cam 16 is in a switch-off position.

Switch drive 18 is pivotally or rotationally mounted by a stud 62 received within a drive stud aperture 64 formed within switch drive 18. Switch drive 18 includes a first arm 66 and a second arm 68. The distal end of first arm 66 includes a projection 70 sized to be slotted within ramp channel 56, and the distal end of second arm 68 engages switch 20. First arm 66 is engaged by ramp channel 56 when switch cam 16 is in the switch-on position (FIG. 1) such that switch drive 18 is in a first drive position. As switch cam 16 rotates, projection 70 slides along ramp channel 56 until switch cam 16 is in the switch-off position (FIG. 2) such that switch drive 18 is held in a second drive position. Projection 70 continues to slide along ramp channel 56 until switch cam 16 is in the switch-on position (FIG. 3) and switch drive 18 is rotated back to the first drive position.

In the exemplary embodiment, pawl switch 20 is a microswitch that provides a signal to controller 48, as described herein in more detail. However, pawl switch 20 may be any suitable switch or sensor that enables assembly 10 to function as described herein. Switch 20 is positioned to engage switch drive second arm 68 such that rotation of switch drive 18 from the second position to the first position causes switch 20 to transition from an "off" position to an "on" position. Although described as "off" and "on" positions, switch 20 may have any suitable position or condition that enables system 10 to function as described herein. In the "off" position, switch 20 sends a signal (or indicates a lack of a signal) to controller 48 to control power closing mechanism 49 to transition latch assembly 10 from the safety position (FIG. 2) to the closed position (FIG. 3). In the "on" position, switch 20 sends a signal (or indicates a lack of a signal) to controller 48 to turn off a motor of power closing mechanism 49, thus facilitating preventing the motor of power closing mechanism 49 from operating when latch assembly 10 is not in a position for a power closing operation (i.e., the open and closed positions shown in FIGS. 1 and 3).

In an exemplary operation, claw 12 begins in an unlatched position (FIG. 1) corresponding to a component such as a vehicle door being in an open position. Ramp 60 of claw 12 engages cam shoulder portion 54 such that switch cam 16 is in the switch-on position, which orients switch drive 18 in the first drive position. In the first drive position, switch drive 18 engages switch 20 into the "on" state where switch 20 sends a signal to controller 48 indicating that the vehicle door is in the open/closed position. Accordingly, because switch 20 indicates the vehicle door is open/closed, controller 48 does not actuate the power close mechanism. Further, additional switches or sensors may be used to provide additional information to controller 48 about the vehicle door. For example, a door-ajar switch (not shown) may be communicatively coupled to controller 48 to facilitate determining a position or condition of the vehicle door along with switch 20.

As the vehicle door moves from the open position (FIG. 1) to the safety position (FIG. 2), claw 12 rotates counter-clockwise and ramp 60 disengages cam shoulder portion 54. Pawl 14 rotates from the first position (FIG. 1) where it is disengaged from claw 12 to the second position (FIG. 2) where pawl shoulder 42 engages claw shoulder 46 to prevent the vehicle door from accidentally moving to the open position. Without the engagement between ramp 60 and shoulder portion 54, biasing member 34 biases switch cam 16 to rotate counter-clockwise, causing switch drive projection 70 to travel along the ramped path of ramp channel 56. The movement of drive projection 70 drops first arm 66 causing switch drive 18 to rotate counter-clockwise and lift second arm 68, thereby transitioning switch 20 to the "off" condition. As such, switch 20 sends a signal to controller 48 that the vehicle door is in the safety position. Controller 48 may subsequently actuate the motor of power closing mechanism 49 to commence a power close operation where claw 12 is rotated counter-clockwise into the latched position (FIG. 3) to safely secure the door in a closed position.

As the vehicle door moves from the safety position (FIG. 2) to the closed position (FIG. 3), claw 12 rotates to the latched position and pawl 14 rotates counter-clockwise to the third position (FIG. 3). From the door open position shown in FIG. 1 to the safety position shown in FIG. 2, switch cam 16 is independently rotatable with respect to pawl 14. However, as pawl 14 rotates from the second position (FIG. 2) to the third position (FIG. 3), a portion 72 of pawl 14 engages pawl contact portion 58 of switch cam 16. From this point, pawl 14 and switch cam 16 are engaged and rotate together in a counter-clockwise direction. Drive projection 70 travels along ramp channel 56 and raises first arm 66 causing switch drive 18 to rotate clockwise and drop second arm 68. Accordingly, in the door closed position, switch 20 is in the "on" position and sends a signal to controller 48 indicating that the door is in the open/closed position. Controller 48 may then cease the power close operation and power-off the power close mechanism motor.

As the vehicle door returns to the open position (FIG. 1), pawl 14 disengages claw 12, and claw 12 rotates counter-clockwise from the latched position (FIG. 3) to the unlatched position (FIG. 1). Pawl 14 rotates from the third position (FIG. 3) to the first position (FIG. 1) and disengages pawl contact portion 58. Switch cam 16 is biased by biasing member 34 and rotates independent of pawl 14 counter-clockwise until shoulder portion 54 engages ramp 60. Switch drive 18 remains in the first drive position such that switch 20 is in the "on" position to send a signal to controller 48 indicating the door is in the open/closed position and the power close operation is not required. The operation of latch assembly 10 may then be repeated as the door again moves from the open position (FIG. 1), to the safety position (FIG. 2), and to the closed position (FIG. 3).

A method of overriding pawl switch 20 is provided. The method includes rotating claw 12 from the latched position (FIG. 3) to the unlatched position (FIG. 1) such that claw 12 engages switch cam 16. Switch cam 16 is rotated from the switch-off position to the switch-on position when claw 12 engages switch cam 16. Pawl switch 20 is transitioned from an "off" condition to an "on" condition when switch cam 16 rotates to the switch-on position. Switch drive 18 is engaged with switch cam 16 and rotates from the first drive position to the second drive position when switch cam 16 moves from the switch-off position to the switch-on position. Switch drive 18 is also engaged with pawl switch 20 such that switch drive 18 causes switch 20 to transition to the "off" condition when switch drive 18 transitions to the second drive position, and causes switch 20 to transition to the "on" condition when switch drive 18 transitions to the first drive position.

Described herein is a latch assembly that includes a pawl override system. The latch assembly facilitates controlling a power close mechanism to operate when a vehicle component is in a safety position and to facilitate preventing operation when the vehicle component is in an open/closed position. The latch assembly and override system include a claw ramp that causes selective rotation of a switch cam, which in turn causes selective rotation of a switch drive to control a condition of a switch. The switch indicates a position of the vehicle component such that the pawl override system prevents unnecessary powering of a power close mechanism. Accordingly, the system facilitates prolonged system life, improved door closure safety, and increased vehicle occupant safety.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch assembly comprising:

a claw movable between a latched position and an unlatched position;

a pawl movable between a first position and a second position, said pawl engaging and holding said claw in said latched position when said pawl is in said first position, said pawl disengaging said claw for movement to said unlatched position when said pawl is in said second position;

a switch cam movable between a switch-off position and a switch-on position, said claw engaging and holding said switch cam in said switch-on position when said claw is in said unlatched position, said claw releasing said switch cam for movement to said switch-off position when said claw rotates to said latched position;

a switch drive movable between a first drive position and a second drive position, said switch cam engaging and holding said switch drive in said first drive position when said switch cam is in said switch-on position, said switch cam engaging said switch drive for movement to said second drive position when said switch cam is in said switch-off position;

a switch configured to produce a signal, said switch cam moving said switch to be in an "on" condition when said switch cam is in said switch-on position, and said switch cam moving said switch to be in an "off" condition when said switch cam is in said switch-off position, wherein said switch indicates an open condition of said latch assembly when said switch is in said "on" condition, and said switch indicates a safety-position condition of said latch assembly when said switch is in said "off" condition;

a controller operatively coupled to the switch; and a power closure mechanism operatively coupled to the controller.

2. The latch assembly of claim 1, further comprising a biasing member eccentrically engaging said switch cam relative to a travel path of said switch cam and biasing said switch cam toward said switch-off position.

3. The latch assembly of claim 2, wherein said biasing member is a torsion spring.

4. The latch assembly of claim 1, wherein said switch drive comprises a first arm and a second arm, said first arm configured to engage said switch cam, and said second arm configured to engage a switch.

5. The latch assembly of claim 4, wherein said switch cam comprises a ramp channel configured to engage said first arm to transition said switch drive between the first and second drive positions.

6. The latch assembly of claim 1, wherein said claw comprises a ramp configured to engage said switch cam when said claw is in said unlatched position and to disengage said switch cam when said claw is in said latched position.

7. The latch assembly of claim 1, wherein said switch cam rotates independently from said pawl for at least a portion of a travel path of said switch cam.

8. An override system for a latch assembly of a vehicle, comprising:

a controller;

a door; and a door latch assembly comprising:

a claw movable between a latched position and an unlatched position;

a pawl movable between a first position and a second position, said pawl engaging and holding said claw in said latched position when said pawl is in said first position, said pawl disengaging said claw for movement to said unlatched position when said pawl is in said second position;

a switch cam movable between a switch-off position and a switch-on position, said claw engaging and holding said switch cam in said switch-on position when said claw is in said unlatched position, said claw releasing said switch cam for movement to said switch-off position when said claw rotates to said latched position; and a switch communicatively coupled to said controller, wherein said switch cam moves said switch to said switch-on position via a switch drive operatively coupled to said switch and said switch cam, wherein said switch drive is movable between a first drive position and a second drive position, said switch cam engaging and holding said switch drive in said first drive position when said switch cam is in said switch-on position, said switch cam engaging said switch drive for movement to said second drive position when said switch cam is in said switch-off position and wherein said switch sends a signal to said controller indicating an open/closed condition of said door; and a power closure mechanism communicatively coupled to said controller and configured to move said claw from a safety position to said latched position, wherein said switch cam disengages said switch in said switch-off position whereby said switch indicates a door safety-position condition to said controller.

9. The vehicle of claim 8, wherein when said switch indicates said door-safety position condition, said controller actuates said power closure mechanism to move said claw from said safety position to said latched position.

10. A method of overriding a switch of a vehicle door closure system, said method comprising:

rotating a claw between a latched position and an unlatched position, wherein the claw engages a switch cam in the unlatched position;

rotating the switch cam from a switch-off position to a switch-on position when the claw engages the switch cam;

transitioning the switch from an "off" condition to an "on" condition via a switch drive operatively coupled to the switch and said switch cam, wherein said switch drive is movable between a first drive position and a second drive position, said switch cam engaging and holding said switch drive in said first drive position when said switch cam is in said switch-on position, said switch cam engaging said switch drive for movement to said second drive position when said switch cam is in said switch-off position, wherein said switch indicates an open condition of said latch assembly when said switch is in said "on" condition, and said switch indicates a safety-position condition of said latch assembly when said switch is in said "off" condition; and operatively coupling the switch to a controller and a power closure mechanism of the vehicle door closure system.

* * * * *